US012650074B2

(12) United States Patent
Demidov et al.

(10) Patent No.: US 12,650,074 B2
(45) Date of Patent: Jun. 9, 2026

(54) METHODS FOR DETERMINING A POSITION OF A DROPPABLE OBJECT IN A WELLBORE

(71) Applicant: Schlumberger Technology Corporation, Sugar Land, TX (US)

(72) Inventors: Demid Valeryevich Demidov, Novosibirsk (RU); Roman Vladimirovich Korkin, Sugar Land, TX (US); Dmitry Viktorovich Badazhkov, Novosibirsk (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 356 days.

(21) Appl. No.: 18/257,307

(22) PCT Filed: Dec. 16, 2020

(86) PCT No.: PCT/RU2020/000694

§ 371 (c)(1),
(2) Date: Jun. 14, 2023

(87) PCT Pub. No.: WO2022/131951

PCT Pub. Date: Jun. 23, 2022

(65) Prior Publication Data

US 2024/0035371 A1 Feb. 1, 2024

(51) Int. Cl.
*E21B 47/095* (2012.01)
*E21B 33/16* (2006.01)
*E21B 47/06* (2012.01)

(52) U.S. Cl.
CPC ..... *E21B 47/095* (2020.05); *E21B 33/16* (2013.01); *E21B 47/06* (2013.01)

(58) Field of Classification Search
CPC ..... E21B 47/095; E21B 47/06; E21B 33/16; E21B 47/09
See application file for complete search history.

(56) References Cited

U.S. PATENT DOCUMENTS 4,571,993 A 2/1986 St. Onge
4,709,357 A * 11/1987 Maki, Jr. ..... E21B 47/005 367/45

(Continued)

FOREIGN PATENT DOCUMENTS

WO 2018004369 A1 1/2018
WO 2021040556 A1 3/2021

OTHER PUBLICATIONS

International Search Report and Written Opinion issued in International Patent application PCT/RU2020/000694 on Jul. 1, 2021, 5 pages.

(Continued)

*Primary Examiner* — Eman A Alkafawi
*Assistant Examiner* — Joseph O Nyamogo
(74) *Attorney, Agent, or Firm* — Jeffrey D. Frantz

(57) ABSTRACT

The position of a droppable object (e.g., a cementing plug or drillpipe dart) in a cased wellbore may be determined in real time during a cementing operation. A pressure data acquisition system is installed at a wellsite, a pressure transducer is installed at the wellhead and a flowmeter is placed to measure fluid displacement rate. The fluid displacement causes the droppable object to travel through the casing towards a target position. During displacement the pressure data and flow-rate data are transmitted to a pressure data acquisition system and a flowmeter, respectively. The pressure and flow-rate data are processed mathematically to obtain pressure pulses, pulse reflections or both. The fluid flow rate data and pressure data are processed by generating a pressure spectrogram converted to pulses. The pulses are then matched with casing tally pulses, thus allowing correction of the droppable object depth.

12 Claims, 7 Drawing Sheets

(56) References Cited

U.S. PATENT DOCUMENTS

| | | | | |
|---|---|---|---|---|
| 4,819,726 | A | 4/1989 | Beirute | |
| 5,754,495 | A | 5/1998 | Skinner | |
| 5,784,333 | A * | 7/1998 | Tang | G01V 1/50 73/152.05 |
| 6,125,935 | A | 10/2000 | Shahin, Jr. | |
| 6,401,814 | B1 | 6/2002 | Owens | |
| 9,546,548 | B2 | 1/2017 | Hartog | |
| 2002/0157828 | A1 | 10/2002 | King | |
| 2004/0060697 | A1 | 4/2004 | Tilton | |
| 2009/0126994 | A1 * | 5/2009 | Tibbitts | E21B 44/00 175/27 |
| 2014/0273831 | A1 | 9/2014 | Walton | |
| 2017/0096891 | A1 * | 4/2017 | Gao | E21B 47/16 |
| 2017/0211569 | A1 | 7/2017 | Urdaneta | |
| 2019/0129047 | A1 * | 5/2019 | Clark | E21B 47/095 |
| 2020/0362688 | A1 * | 11/2020 | Jack | E21B 47/09 |
| 2022/0056793 | A1 | 2/2022 | Korkin | |

OTHER PUBLICATIONS

Leugemors E et al.: "Cementing Equipment and Casing Hardware," in Nelson EB and Guillot D (eds.): Well Cementing-2nd Edition, Houston, Schlumberger (2006) 343-458.

Piot B and Cuvillier G: "Primary Cementing Techniques," in Nelson EB and Guillot D (eds.): Well Cementing-2nd Edition, Houston, Schlumberger (2006) 459-501.

Trogus et al., "Studies of Cement Wiper Plugs Suggest New Deepwater Standards," paper SPE/IADC-173066-MS, presented at the SPE/IADC Drilling Conference and Exhibition, London, UK, Mar. 17-19, 2015, 9 pages.

* cited by examiner

METHODS FOR DETERMINING A POSITION OF A DROPPABLE OBJECT IN A WELLBORE

CROSS REFERENCE TO RELATED APPLICATION(S)

This application is a National Stage Entry of International Patent Application No. PCT/RU2020/000694, filed on Dec. 16, 2020.

TECHNICAL FIELD

The present disclosure relates generally to cementing operations. In particular, the disclosure relates to using pressure pulses to determine the positions of wiper plugs and drillpipe darts inside a casing string.

BACKGROUND

During the construction of underground wells, it is common, during and after drilling, to place a tubular body such as a liner or casing, secured by cement pumped into the annulus around the outside of the tubular body. The cement serves to support the tubular body and to provide isolation of the various fluid-producing zones through which the well passes. This latter function prevents cross-contamination of fluids from different layers. For example, the cement prevents formation fluids from entering the water table and polluting drinking water, or prevents water from passing into the well instead of oil or gas. Furthermore, the cement sheath helps prevent corrosion of the tubular body.

The cement placement process is known in the industry as primary cementing. Most primary cementing operations employ the two-plug cement-placement method. FIG. 1 shows a typical wellsite configuration 100 for a primary cementing operation. A cementing head 101 is situated on the surface, and a casing string 103 is lowered into a borehole 102. As the casing string 103 is lowered into the borehole 102, the casing string interior fills with drilling fluid 108. The casing string is centered in the borehole by centralizers 104 attached to the outside of the casing string. Centralizers are placed in critical casing sections to prevent sticking while the casing is lowered into the well. In addition, they keep the casing string in the center of the borehole to help ensure placement of a uniform cement sheath in the annulus between the casing and the borehole. The bottom end of the casing string is protected by a guide shoe 105 and a float collar 109. Guide shoes are tapered, commonly bullet-nosed devices that guide the casing toward the center of the hole to minimize hitting rough edges or washouts during installation. The guide shoe differs from the float collar in that it lacks a check valve. The check valve in a float collar can prevent reverse flow, or U-tubing, of fluids from the annulus into the casing. Inside the cementing head 101 are a bottom cementing plug 106 and a top cementing plug 107. The cementing plugs, also known as cementing wiper plugs or wiper plugs, are elastomeric devices that provide a physical barrier between different fluids as they are pumped through the casing string interior. Most cementing plugs are made of a cast aluminum body with molded rubber fins that ensure steady movement through a tubing.

The goals of the primary cementing operation are to remove drilling fluid from the casing interior and borehole, place a cement slurry in the annulus, and leave the casing interior filled with a displacement fluid such as brine or water. The bottom cementing plug 106 separates the cement slurry from the drilling fluid, and the top cementing plug 107 separates the cement slurry from the displacement fluid.

Cement slurries and drilling fluids are usually chemically incompatible. Commingling may result in a thickened or gelled mass at the interface that would be difficult to remove from the wellbore, possibly preventing the placement of a uniform cement sheath throughout the annulus. Therefore, in addition to using wiper plugs, engineers employ both chemical means to maintain fluid separation. Chemical washes and spacer fluids may be pumped between the cement slurry and drilling fluid. These fluids have the added benefit of cleaning the casing and formation surfaces, which is helpful for achieving good bonding with the cement.

FIG. 2 shows a chemical wash 201 and a spacer fluid 202 being pumped between the drilling fluid 108 and the bottom cementing plug 106. Cement slurry 203 follows the bottom cementing plug. The bottom cementing plug has a membrane that ruptures when it lands at the bottom of the casing string, allowing cement slurry to pass through the bottom cementing plug and enter the annulus (FIG. 3).

Once a sufficient volume of cement slurry has been pumped to fill the annular region between the casing string and the borehole wall, the top cementing plug 107 is released, followed by the displacement fluid 301. The top cementing plug 107 does not have a membrane; therefore, when it lands, hydraulic communication is severed between the casing interior and the annulus (FIG. 4). After the cementing operation, engineers wait for the cement to set and develop strength—known as "waiting-on-cement" (WOC). After the WOC time, further operations such as drilling deeper or perforating the casing string may commence.

Conventional cementing plugs are pumped directly from the surface because they pass through only one pipe with a continuous inside diameter (ID). Liners, on the other hand, do not begin at the surface; instead, they are run downhole on the drillstring to the setting depth. Liners typically have a much larger ID than the drillstring; as a result, a single cementing plug cannot be pumped from the surface. Therefore, the displacement is performed by two plugs. One plug, known as the drillpipe dart, is located in the surface cementing equipment. The second plug is either attached to the bottom of the liner setting tool assembly, or the top of the liner setting tool assembly. The second plug is called a liner wiper plug.

After the cement has been pumped in the liner and the drillstring, the drillpipe dart (a droppable object) is released from the surface cementing equipment. When the drillpipe dart reaches the top of the liner, it latches into the liner wiper plug. Both the drillpipe dart and the liner wiper plug then become a single divider between the cement slurry and the displacement fluid. This arrangement may be seen in extended-reach wells and multistage cementing applications.

Additional information concerning cementing plugs, drillpipe darts and primary cementing operations may be found in the following publications. Leugemors E et al.: "Cementing Equipment and Casing Hardware," in Nelson E B and Guillot D (eds.): *Well Cementing—2nd Edition*, Houston, Schlumberger (2006) 343-458. Piot B and Cuvillier G: "Primary Cementing Techniques," in Nelson E B and Guillot D (eds.): *Well Cementing—2nd Edition*, Houston, Schlumberger (2006) 459-501. Trogus M: "Studies of Cement Wiper Plugs Suggest New Deepwater Standards," paper SPE/IADC-173066-MS, presented at the SPE/IADC Drilling Conference and Exhibition, London, UK, 17-19 Mar. 2015.

Deviations from the idealized cementing operation depicted above may occur. Possible reasons include borehole rugosity leading to inaccurate displacement volume calculations, pump rate fluctuations, differences between nominal and actual casing geometry, lost circulation, casing deformation and fluid loss. With these uncertainties, operators and engineers are motivated to achieve real-time monitoring of cementing plug positions, as well as locate the top of the cement (TOC) sheath in the annulus.

SUMMARY

In an aspect, embodiments relate to methods for determining a position of a droppable object inside a casing string. A casing string is installed in a wellbore, during which a fluid medium in the borehole enters and fills the interior of the casing string. A droppable object is then placed inside the casing string. The droppable object may be a top cementing plug, a bottom cementing plug or a drill pipe dart. A fluid is then pumped behind the droppable object, causing the droppable object to travel through the interior of the casing string to a target position.

Pressure data, fluid flow rate data are recorded and transmitted to a data acquisition system. The pressure and fluid flow rate data are then processed mathematically to obtain a pressure spectrogram that is converted to pulses. The pulses are matched with casing tally pulses to determine the correct depth of the droppable object.

DETAILED DESCRIPTION

Figure 1:
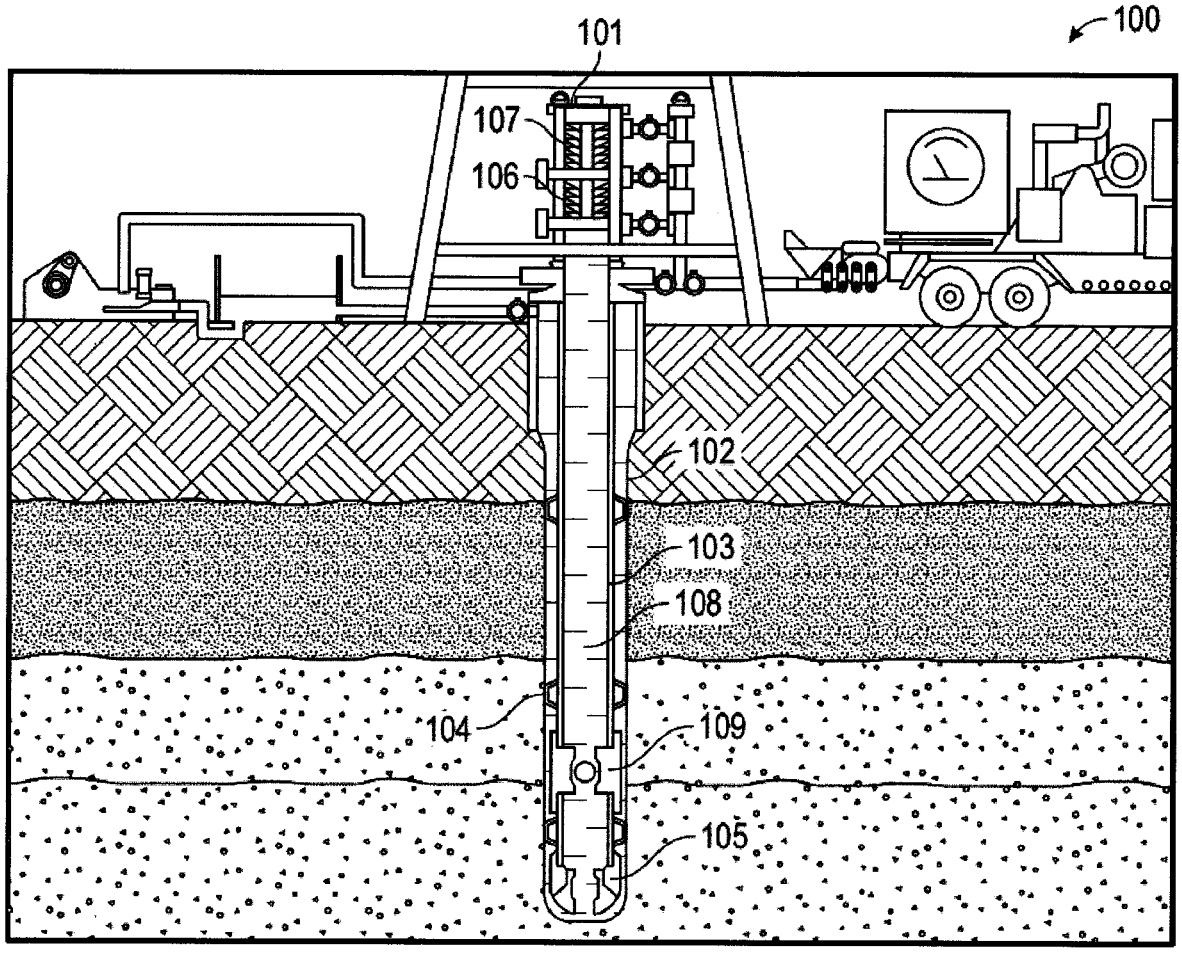
FIG. 1 shows a typical wellsite configuration during a cementing operation.
Figure 2:
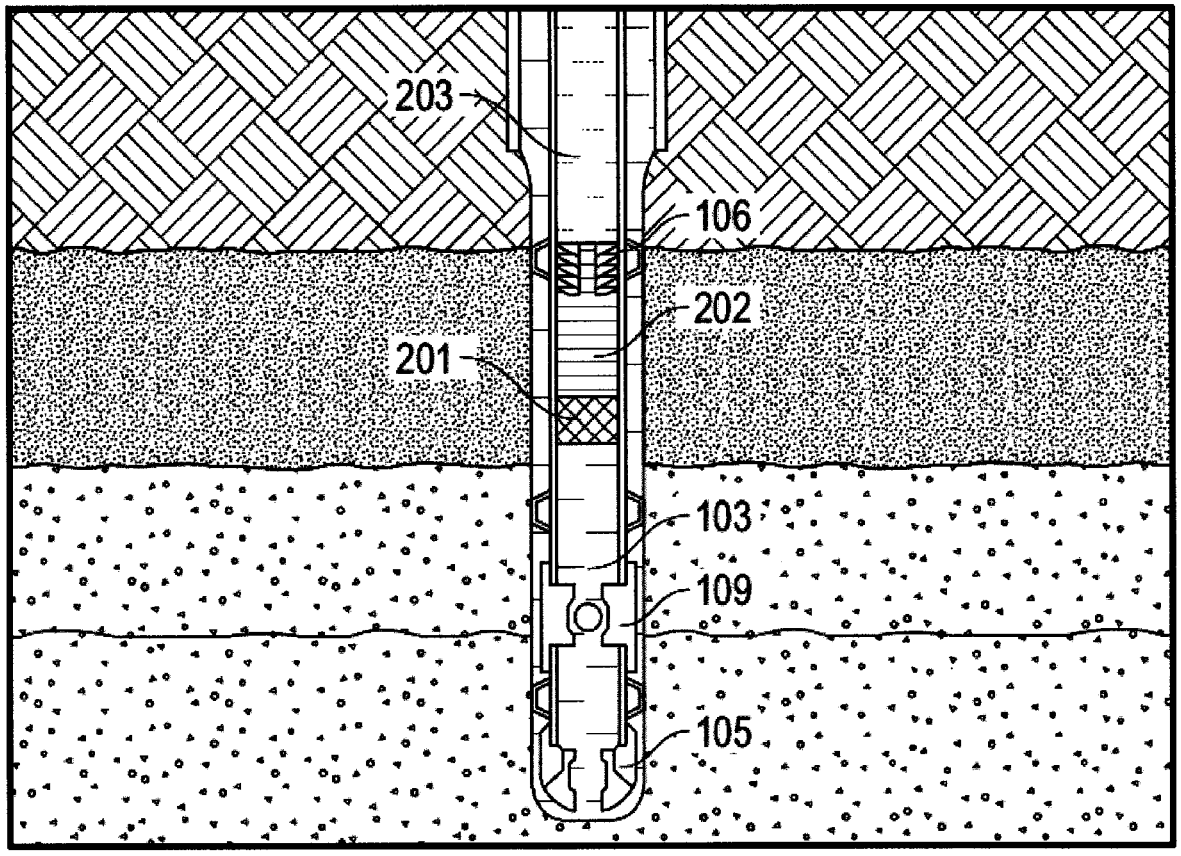
FIG. 2 shows a cementing operation in progress. The bottom cementing plug has been released, separating the cement slurry from chemical washes, spacer fluids and drilling fluid.
Figure 3:
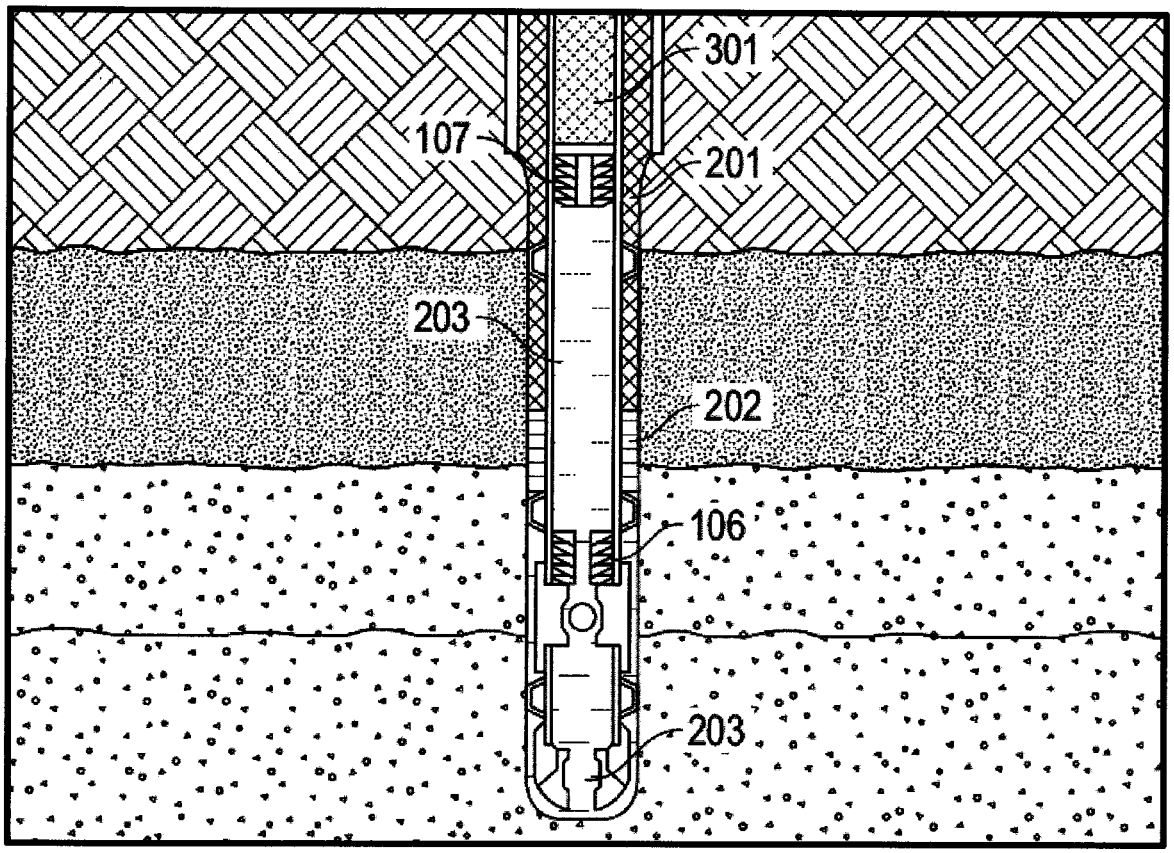
FIG. 3 shows a cementing operation in progress. The bottom cementing plug has landed on the float collar. A membrane in the bottom cementing plug ruptures, allowing cement slurry to enter the annulus between the casing string and the borehole wall.
Figure 4:
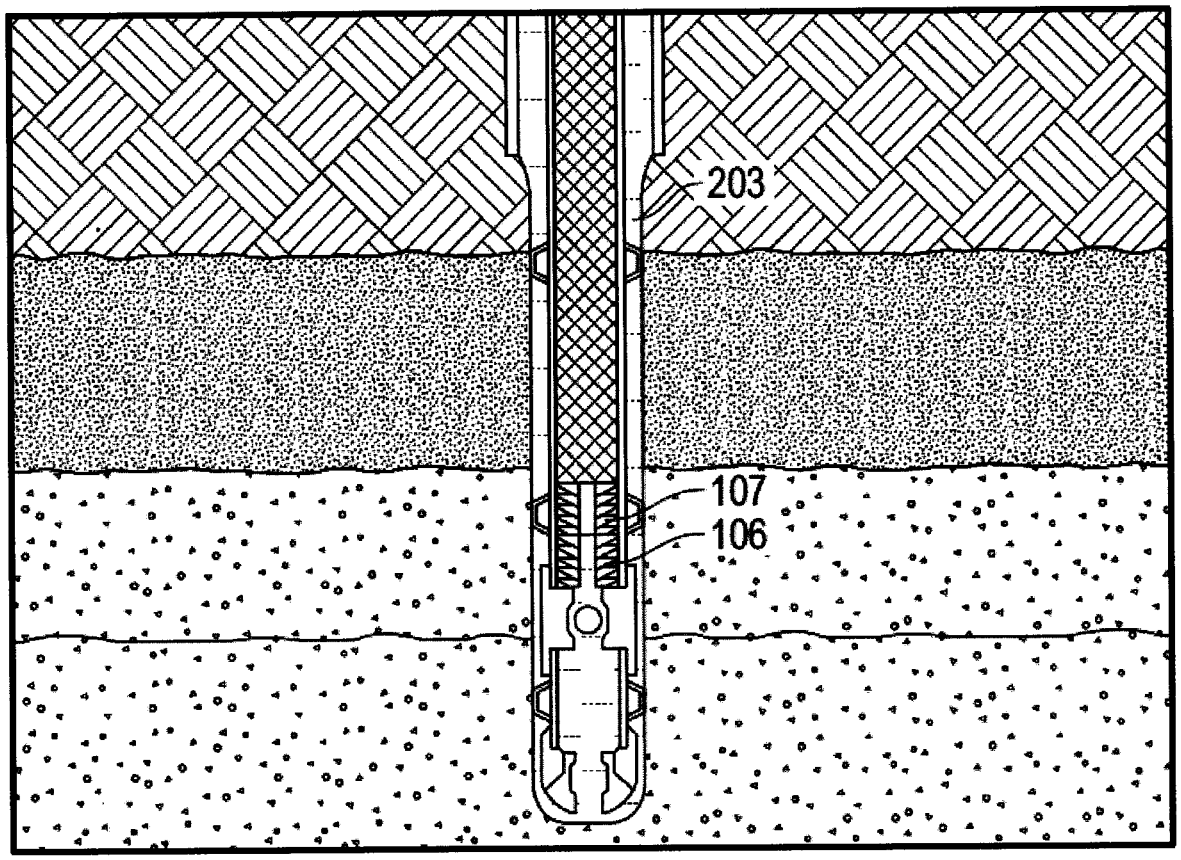
FIG. 4 shows a completed cementing operation. Cement slurry fills the annulus, both cementing plugs have landed on the float collar, and the interior of the casing string is filled with displacement fluid.

At the outset, it should be noted that in the development of any such actual embodiment, numerous implementations—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific points, it is to be understood that inventors appreciate and understand that any and all data points within the range are to be considered to have been specified, and that inventors possessed knowledge of the entire range and all points within the range.

This disclosure pertains to detecting the position of droppable objects in a casing string or liner during a well cementing operation. The droppable objects may comprise top or bottom cementing plugs and drill pipe darts.

In an aspect, embodiments relate to methods for determining a position of a droppable object inside a casing string. A casing string is installed in a wellbore, during which a fluid medium in the borehole enters and fills the interior of the casing string. A droppable object is then placed inside the casing string. The droppable object may be a top cementing plug, a bottom cementing plug or a drill pipe dart. A fluid is then pumped behind the droppable object, causing the droppable object to travel through the interior of the casing string to a target position.

Pressure data, fluid flow rate data are recorded and transmitted to a data acquisition system. The pressure and fluid flow rate data are then processed mathematically to obtain a pressure spectrogram that is converted to pulses. The pulses are matched with casing tally pulses to determine the correct depth of the droppable object.

The methods and measurements disclosed herein may be performed in real time during a cementing operation. The ability to locate droppable objects in real time allows operators to make instant decisions concerning the progress of the treatment, for example, whether to continue or discontinue displacement, volumes of fluids to be introduced into the wellbore and pumping rates.

A method and system for locating steady downhole objects that reflect a hydraulic signal are disclosed in the patent application WO 2018/004369. The monitoring of the well is based on cepstral analysis of pressure data recorded at the wellhead. It is designed to locate steady downhole objects that reflect a hydraulic signal. A hydraulic signal is detected by a pressure sensor, then the pressure data are processed to obtain their properties such as tube wave reflection times. One (but not the only) method of obtaining such information is a cepstrum analysis. The cepstrum analysis is widely used in various applications, for example for hydraulic fracturing operations monitoring. The cepstrogram allows detection of objects that reflect the hydraulic signal. This method for hydraulic fracturing operations uses hydraulic signal sources including the water hammer effect, noise from surface or submersible pumps and perforating events.

U.S. Pat. No. 6,401,814 discloses a method for locating a cementing plug in a subterranean well during cementing operations using pressure pulse reflections. Once generated, pressure pulses are transmitted through displacement fluid, reflected off the cementing plug and, finally, received by a pressure sensor. A location of the plug is calculated from reflection time and pressure pulse velocity in the given media. The method of generating and transmitting of pressure pulse through the fluid in a casing string comprises momentarily opening a valve installed in the flowline of the well. Other methods of pressure pulse generation include an air gun, varying the pump's engine speed or disengaging the pump.

U.S. Pat. No. 4,819,726 discloses a method for indicating the position of a cement wiper plug prior to its bottomhole arrival. It comprises an apparatus that includes a section of pipe string with an interior shearable, temporary means of restricting the motion of the cement wiper plug through the section of pipe string. The arrival of the cementing plug at the shearable, temporary restriction means in a pipe string is sensed by an increase in pipe string pressure at the surface and monitored by a pressure sensor.

U.S. Pat. No. 9,546,548 discloses a device and a method of use for cement sheath analysis based on acoustic wave propagation. It consists of an acoustic wave detection apparatus, comprising a fiber optic cable drawn down in a well, an optical source and a data acquisition system. The acoustic source produces a compressional wave in a casing string. The pressure in the annulus is determined as the cement slurry sets, and this pressure is compared to the maximum formation pressure as an indication of whether the cement had set to a strength, enough to maintain an effective formation-to-casing seal across the annulus.

PCT/RU2019/000600 discloses a method for determining the position of a droppable object (e.g., a cementing plug or drillpipe dart) in a cased wellbore in real time during a cementing operation. It comprises installing a pressure data acquisition system at a wellsite and a pressure transducer at the wellhead. As the droppable object travels through casing it encounters regions with a positive or a negative change of inner cross-sectional dimension. The droppable object generates pressure pulses as it passes through the regions. The pressure pulse and associated reflections are detected by the pressure transducer, and the signals are processed mathematically to determine the position of the droppable object. However, the pressure pulse velocity is not known during displacement of the droppable object and may be measured only after the cementing operation is completed, or estimated indirectly with unknown accuracy. Hence, cepstral analysis of high frequency pressure data disclosed in PCT/RU2019/000600 provides only the values of pulse propagation time to the droppable object and back, which cannot be easily converted to the distance from the wellhead to droppable object in real time.

This disclosure presents real-time methods for detecting the position of a droppable object in the wellbore during liner or casing cementing operations. Traditionally, the plug position may be tracked by the so-called volumetric method; i.e. dividing the displaced fluid volume by the casing cross sectional area. The displaced volume may be measured by a surface flowmeter or by counting the cementing pump strokes. The casing cross sectional area may be calculated from the inner casing diameter. This method of cement plug monitoring based on tracking pumped volume will hereinafter be referred to as the volumetric method.

In the methods disclosed in this application, pressure pulses are generated by a cementing pump unit or when a cementing plug passes through casing collar joints where a variation of inner diameter of the casing takes place.

The volumetric estimation of the plug depth may be inaccurate due to several sources for error, including: flow rate uncertainty, casing diameter uncertainty, fluid compressibility and temperature expansion. Furthermore, pressure pulses not related to the movement of the droppable object may result from noise or a pump-rate change. As a result, the actual positions of a cementing plug and top of cement may differ from the traditional volumetric predictions. Accordingly, there is a need in the art to have methods for monitoring the cementing plug and top of cement positions during a cementing operation to recognize possible issues in timely manner and take appropriate remedial actions.

The presently disclosed methods comprise performing "time window" analysis to evaluate minimal time delay between pulses in different time windows and then detecting peaks that have a time delay longer than the minimal one. Instead of a simple correlation between expected and detected pulses, the presently disclosed methods match two binary vectors reflecting the presence of pulses at a given moment in time with the presence of neighboring casing joints for the evaluated plug speed. Expected pulses are calculated for an assumed plug speed (which differs from the volumetric method by a correction factor of 0.9-1.1) and then the expected binary vector matches the observed. This matching is performed for various correction factors, so that the best one is computed. The matching of peaks binary vectors in specific time windows with the presence or absence of peaks (1 or 0) allows a significant reduction in noise coming from different sources.

Figure 5:
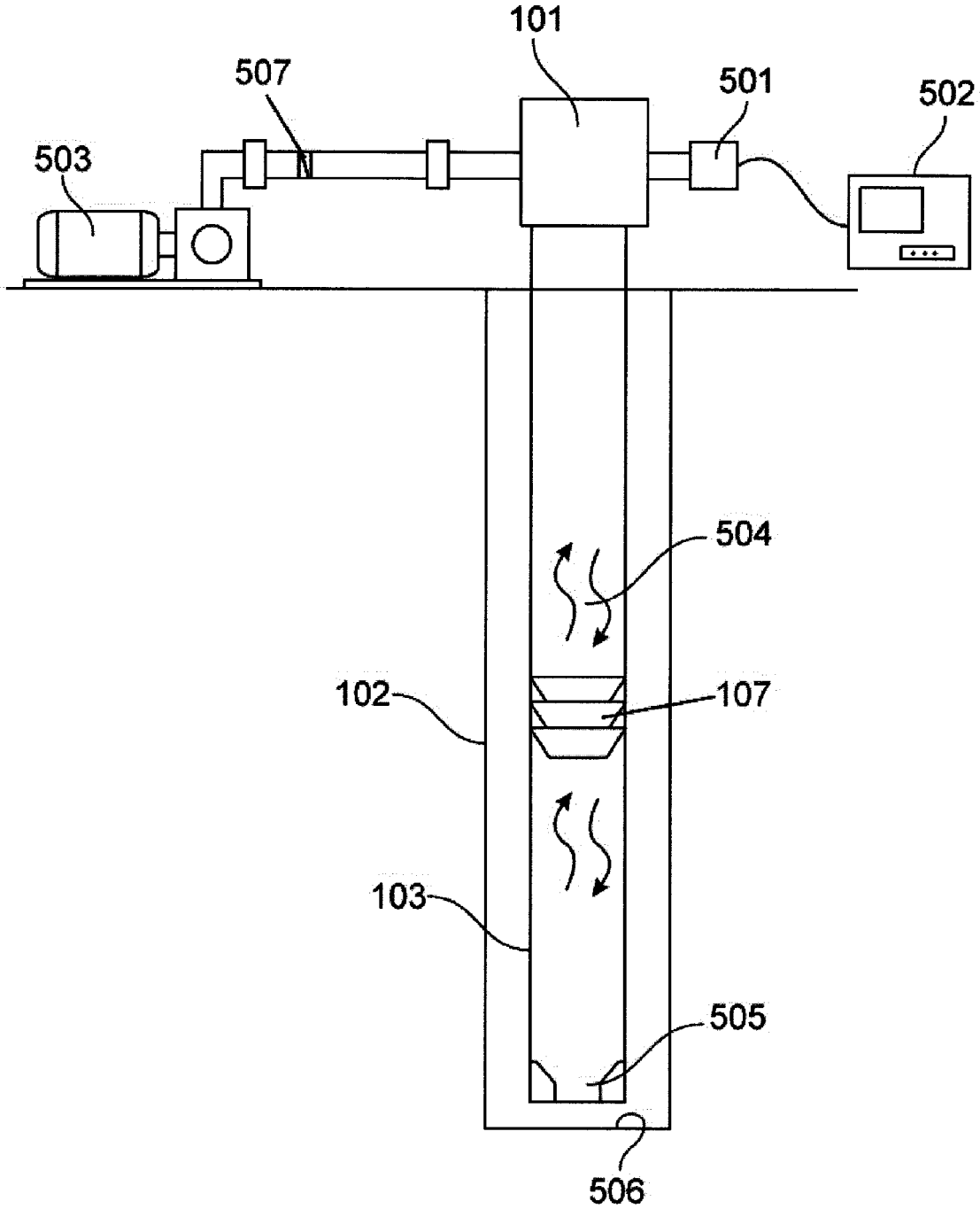
FIG. 5 is an illustration of a well configuration for practicing the disclosed methods.

The disclosed method employs an assembly (FIG. 5) that comprises a borehole 102, fluid-filled casing string run into borehole 102, a pressure transducer 501 installed at the surface (wellhead or cementing head), an acquisition system 502 for pressure data recording, and at least one pump 503 (with pump rate counter 507) connected to the casing string via the cementing head 101. The pressure pulses may be recorded within a frequency range between 20 and 2000 Hz. Once generated, a pressure pulse 504 may propagate in the fluid-filled borehole and reflect from various objects. The pulse reflection objects are any physical or geometrical changes in the borehole and casing string, that may include, but not limited to a moving objects such as a cementing plug 107, top of cement and fluid interfaces, or stationary objects such as a landing collar 505, a liner, a check valve, a bottomhole 506, fractures and vugs. Pulse propagation and reflection may occur several times until they completely attenuate. Pulse reflections from various objects are detected by the pressure transducer installed at the surface and data are captured by the acquisition system. Recorded pressure data are then processed with a mathematical algorithm and reflection times from various objects are obtained.

Persons skilled in the art will recognize that the disclosed methods may further comprise placing a bottom cementing plug inside the casing string. Cement slurry may be pumped behind the bottom cementing plug. The bottom cementing plug may travel through the interior of the casing string and pass through at least one region with a negative or a positive change of inner cross-sectional dimension, thereby generating a pressure pulse. The at least one pressure transducer may be used to detect the pressure pulse and transmit pressure data to the pressure data acquisition system. The pressure data may be processed mathematically and the position of the bottom cementing plug may be determined.

Monitoring of the bottom cementing plug may proceed at least until the top cementing plug is launched.

EXAMPLE

The following example serves to further illustrate the disclosure.

Figure 6:
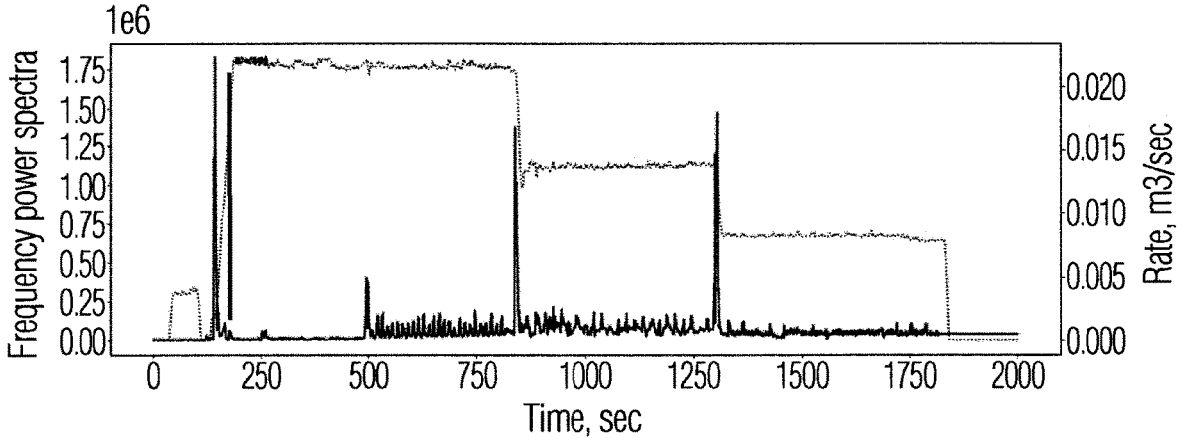
FIG. 6 depicts a low-noise frequency power spectrum during a cementing operation.

The presently disclosed method utilizes high frequency pressure monitoring. The pressure signal is filtered and analyzed by "window-wise spectrogram." The frequency power spectrum allows pressure pulse detection. These pulses are generated when the cementing plug or dart pass casing collar joints (FIG. 6). The dotted line represents the pumping rate; the solid line represents the pressure spectrum. The time delay between high amplitude pulses depends on the pumping rate for the displacement fluid and distance (interval) between casing joints.

The corresponding spectrum analysis and casing tally allow one to follow the top plug during the cementing operation. However, this method has several limitations. One is the U-tubing effect when, during the initial minutes of the operation, the plug free falls in the wellbore. During this period the wellhead pressure is negative or close to zero, and accordingly pressure spectrum analysis cannot be performed. Another limitation occurs when pressure pulses are generated by a rapid change in pumping rate and additional pressure pulses are caused by pump noise not directly related to the plug movement. All of these "parasite" pulses might have similar or higher amplitudes compared to the pressure pulses from the plug passing a casing collar. These factors make direct counting challenging and almost impossible in real-time measurements with noisy power spectrum density.

Figure 7:
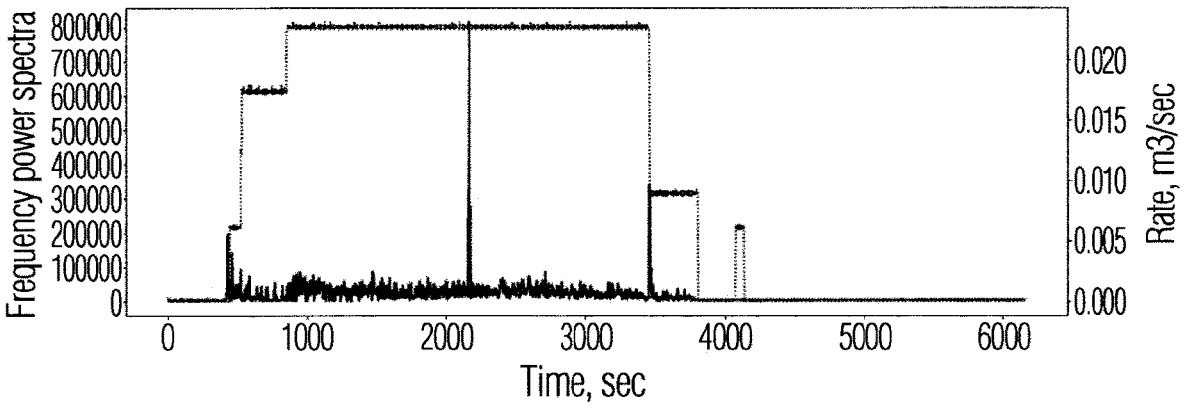
FIG. 7 depicts a noisy frequency power spectrum during a cementing operation.

An example of noisy power spectrum density is presented in FIG. 7. Here, there are just few peaks related to the casing joints, while most of them are invisible. At the same time there are strong spikes in the time interval between 4000 and 5000 sec when the pumping rate is zero. Like FIG. 6, the dotted line represents the pumping rate; the solid line represents the pressure spectrum.

To avoid misinterpretation of the power spectral density, the following approach was used. The smart peaks detection algorithm was implemented whereby the peaks are searched window-wise. Each window corresponds to a depth interval that contains at least 8-12 casing joints. The plug depth is estimated using the volumetric method. Then, in this depth interval, the peaks on the spectrogram are searched such that the time delay between them should not be shorter than the typical distance between casing joints divided by the predicted plug speed. If the peak is available, the signal has a value of one (1) at given time; otherwise, the value is zero (0). The windows are shifted from one to another at times corresponding to a depth of two to three casing joints. In this case the randomly located noise peaks may be located and mostly rejected due to the restriction of time delay. Some "parasite" peaks may still remain (containing zero (0) and one (1) signals), so their contribution will not be critical as mostly only expected peaks will be considered.

Moreover, large spikes arising from a rapid pump rate change or other event may be counted, but only with the same coefficients (1) as all other pressure peaks related to the signal. Thus, assuming the number of such spikes is significantly lower than the number of casing joints, the extraneous spikes will not affect measurement accuracy.

These peaks found at the spectrogram can further be matched window-wise with the peaks arising from casing joints, the moments of time being computed in the following way:

$$t_i = \frac{\Delta L_i}{cv(t)},$$

where $\Delta L_i$ is the distance between i and i+1 casing joints (basically the length of the i-th casing), v(t) is the value of volumetrically calculated plug speed at this time and c is a correction factor (normally between 0.8 and 1.2 but may be lower if more information is available). The value of the correction factor is also searched in a window-wise sense, so that it changes along the wellbore depth. This allows building another set of digital vectors (one for each correction coefficient) with zeros and ones, where ones correspond to the expected time with joint crossing.

Further, the first digital vector (from real observed peaks) is matched with one of the vectors from a set of expected peaks, and the best matching in terms of overlapping is found. Such matching indicates a correction coefficient (or set of correction coefficients, if few match equally well) in a given time window, i.e. in the time interval which corresponds to a depth of 100-200 meters. Splitting the whole job into time intervals allows one to make better predictions, as the correction factor generally slightly differs during the job time. Then, taking into account the correction coefficient allows a smooth change from window to window (or from one depth to another if the depth difference is only 2-3 casing lengths or typically 20-30 m), it is possible to accumulate sufficient data concerning the correction coefficient, averaging the measurements at different depths or evaluating how the coefficient changes with depth.

Note that the correction coefficient may differ according to many factors: inaccuracy of a flowmeter to measure cement and mud volume, casing internal diameter uncertainty, and physical effect of mud compressibility at pressure as well as temperature expansion. Finally, these factors may contribute to an effective correction factor of around 0.9 instead of 1.0 (especially for water-based mud), resulting in a 500-m error for a 5000 m well.

Figure 8:
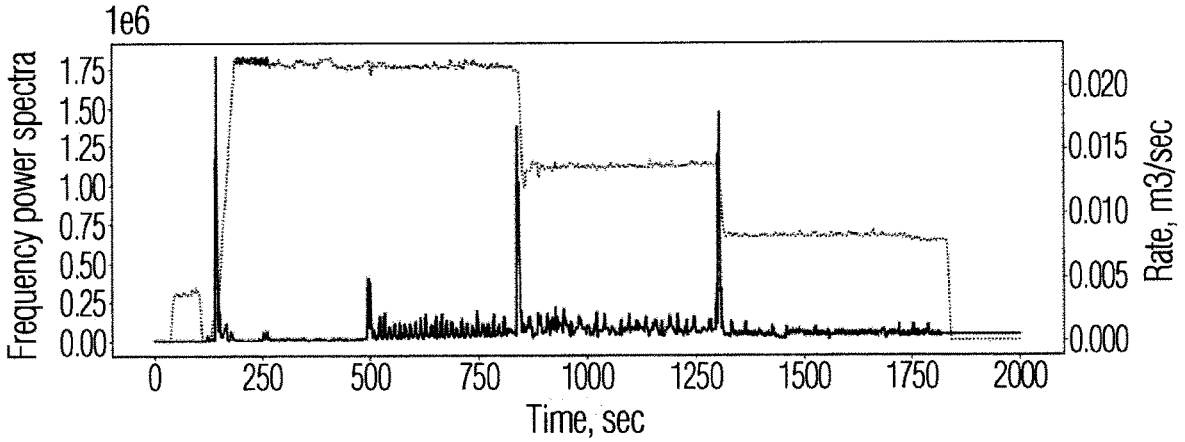
FIG. 8 depicts measured pressure pulses that match well with those expected by a volumetric calculation.
Figure 9:
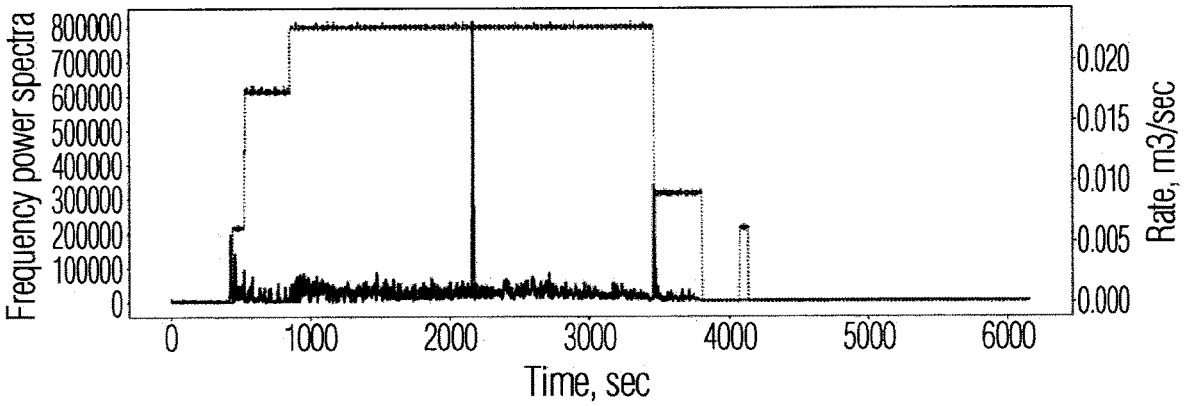
FIG. 9 depicts measured pressure pulses that match poorly with those expected by a volumetric calculation.

In FIGS. 8 and 9, two examples are shown: a good match and a bad match. It is evident that the overlapping is much worse in the bad-match case, though the difference in the predicted depth predicted is rather small—approximately 20 m. The dotted lines represent the expected peaks; the solid lines represent measured peaks.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

The invention claimed is:

1. A method for determining a position of a droppable object inside a casing string, comprising:

(i) placing the droppable object inside an interior of the casing string;

(ii) pumping a fluid behind the droppable object, causing the droppable object to travel through the interior of the casing string to a target position;

(iii) recording pressure data and fluid flow rate data, and transmitting the pressure data and the fluid flow rate data to a data acquisition system; and (iv) processing the fluid flow rate data and processing the pressure data by:

obtaining a window-wise pressure spectrogram converted to pulses, matching the pulses with casing tally pulses, wherein each match indicates a correction coefficient in a corresponding window, and correcting a depth of the droppable object using the correction coefficient.

2. The method of claim 1, wherein the pressure data and the fluid flow rate data processing is performed at a time later than a pressure transient process that occurs responsive to movement of the droppable object.

3. The method of claim 1, further comprising:

converting the window-wise pressure spectrogram into the pulses by frequency pressure monitoring.

4. The method of claim 3, wherein a set of digital vectors is constructed, wherein each digital vector in the set of digital vectors corresponds to a correction coefficient.

5. The method of claim 4, wherein the set of digital vectors represent observed pressure peaks and expected pressure peaks.

6. The method of claim 3, wherein the pressure data is selected only from a set of pressure data having a time delay that is possible according to the casing tally pulses and the fluid flow rate data.

7. The method of claim 1, wherein the droppable object is a top cementing plug, a bottom cementing plug, or a drill pipe dart.

8. The method of claim 1, wherein a source of the pulses comprises casing collars or noise from a pressure pump.

9. The method of claim 1, wherein the data acquisition system installed at a wellsite comprises:

a pressure transducer configured to record pressure data;

a flowmeter configured to record fluid flow rate data; and a data processing unit installed at a wellhead.

10. The method of claim 1, further comprising:

determining the position of the droppable object in real time.

11. The method of claim 1, wherein matching the pulses with casing tally pulses includes:

computing a moment of time $t_i$ for each pulse such that $t_i$ $\Delta L$ i/cv(t), where $\Delta L$; is a distance between i and i+1 casing joints, v(t) is a volumetrically calculated speed of the droppable object at time $t_i$, and c is a corresponding correction coefficient.

12. The method of claim 1, further comprising:

searching the window-wise pressure spectrogram such that a time delay between peaks of the pulses is at least a predicted distance between casing joints divided by a predicted speed of the droppable object.

* * * * *